US005605284A

United States Patent [19]

Young

[11] Patent Number: 5,605,284

[45] Date of Patent: Feb. 25, 1997

[54] ELASTIC RAIL CLAMPS

[75] Inventor: Hartley F. Young, Melton, Australia

[73] Assignee: Pandrol Limited, Addlestone, Great Britain

[21] Appl. No.: 512,183

[22] Filed: Aug. 7, 1995

[30] Foreign Application Priority Data

Aug. 8, 1994 [GB] United Kingdom ..... 9415981

[51] Int. Cl.[6] ..... E01B 9/30

[52] U.S. Cl. ..... 238/351; 238/349

[58] Field of Search ..... 238/338, 349, 238/351, 352

[56] References Cited

U.S. PATENT DOCUMENTS

| | | | |
|---|---|---|---|
| 3,067,947 | 12/1962 | Deenik et al. | 238/349 |
| 4,150,792 | 4/1979 | Qureshi | 238/349 |
| 4,313,563 | 2/1982 | Young | 238/349 |
| 4,379,521 | 4/1983 | Young et al. | 238/351 |
| 4,688,719 | 8/1987 | Young et al. | 238/351 |

FOREIGN PATENT DOCUMENTS

| | | |
|---|---|---|
| 630250 | 10/1992 | Australia . |
| 1143218 | 2/1963 | Germany . |
| 3003867 | 9/1981 | Germany . |
| 7503503 | 9/1976 | Netherlands . |
| 1217531 | 1/1968 | United Kingdom . |
| 1531882 | 3/1976 | United Kingdom . |
| 2269198 | 2/1994 | United Kingdom . |
| 8100581 | 3/1981 | WIPO . |
| 9410382 | 5/1994 | WIPO . |
| 9518888 | 7/1995 | WIPO . |

*Primary Examiner*—S. Joseph Morano

*Attorney, Agent, or Firm*—Norbert P. Holler; Gottlieb, Rackman & Reisman, P.C.

[57] ABSTRACT

An elastic rail clamp (10), for fastening a rail to an underlying rail plate or rail tie (1). The clamp is of the type comprising a pair of substantially parallel members (19) folded into a D configuration so as to have a front toe portion (16) adapted to seat on a flange of the rail, which toe portion is formed by respective free end regions (18) of the substantially parallel members, and to also have a base portion (11) adapted to seat in a slot (4) in the rail plate or a shoulder secured to the rail tie. The clamp is shaped such that the parts (14) of the substantially parallel members between the base portion (11) and the toe portion (16) are tapered in external dimensions towards the toe portion of the clamp, and the free end regions (18) of the substantially parallel members are turned back toward a rear portion (13) of the clamp and project outwardly so as to abut a portion of the rail plate or of the shoulder secured to the rail tie when the clamp is in use, thereby to prevent the clamp from sliding off the rail flange. Alternatively or in addition, the pair of substantially parallel members (19) are joined together by a web (13) between the toe portion (16) and the base portion (11).

8 Claims, 3 Drawing Sheets

ELASTIC RAIL CLAMPS

This invention relates to elastic rail clamps, used in rail fastening systems, of the kind which are applied at right angles to the rail.

BACKGROUND OF THE INVENTION

Elastic rail clamps of this kind are described in U.S. Pat. Nos. 3,067,947 (Deenik) and 4,313,563 (Young). Generally both these clamps are designed for use with a custom made shoulder into which the base of the elastic clamp fits. Both rail clamps have toe portions which lie on the rail flange and the outer edges of these abut the support shoulder to prevent them sliding off the rail flange. The "Young" clip is used with a shoulder as described in U.S. Pat. No. 4,688,719 which has a shoulder with a tapered slot leading to the gate which acts to compress the arms together as the clamp is driven into place with the toe portion of the rail flange.

However, many railway tracks that are already laid have existing rail plates or shoulders but could be upgraded at low cost by utilizing an elastic rail clamp without having a custom built support shoulder. A common rail plate used in Europe is called a K plate which includes a pair of parallel ribs adjacent and parallel to the rail flange and slots in the ribs at right angles to the rail flange. These slots are not tapered and thus the toes of the rail clamps need to be compressed to pass through the slot if the toes are to be prevented from sliding off the rail flange. The Deenik clip can only be applied to the K plate with a tool which compresses the arms of the toe portion to pass through the gate in the shoulder. With older rail tracks the variation in height between rail plate slot and rail flange can vary greatly in stationary and dynamic modes and thus maximum clamp deflection between the base of the toe portions is needed.

BRIEF DESCRIPTION OF THE INVENTION

It is the object of this invention to provide an elastic rail clamp which can be used in rail tracks without a custom built rail shoulder.

In one aspect of this invention there is provided an elastic rail clamp comprising a base portion and a toe portion wherein the toe portion lies on the rail flange and the base portion is adapted to be secured to a rail plate or rail tie, said clamp comprising a pair of substantially parallel members bent into a D configuration such that one end of said pair of members forms the toe of the clamp and the other end forms the base of said clamp, the pair of members being joined together between the curved portion of the members adjacent the base portion.

This arrangement means that the base comprises two free arms extending toward the rail. This contrasts with "Deenik" which had a U-shaped base where the base of the U was next to the rail and provided no free movement for the individual members, and also contrasts with "Young" which had a solid base portion. The advantage which arises from the provision of free ends for the base is greater deflection for the clamp which means it can fit into a wider range of rail track environments. The provision of the junction between the members at a position at the rear of the clamp just above the base means that there is a large non-critical area as a target for hitting the clamp with a sledge hammer to drive the clamp into position. In addition, this is the portion of the clamp most likely to receive high sideward forces from ballast pressure during ballast regulation and the fact that the two members of the clamp are joined at this position minimises the possibility of clamp damage. In summary, joining the members together at the rear of the clamp provides a means to maximize clamp deflection for a given toe load while retaining sufficient strength to minimise damage during application of the clamp and during track working processes such as ballast regulation.

Preferably to improve deflection even further the legs of the base are tapered toward their ends.

The clamps may be formed from rod or bar steel. Preferably the clamps are formed from 40 mm wide bar stock in a forging and shaping operation. In some situations the base needs to be of a wider dimension than the width of the stock bar. By widening the gap between the legs in the base so that they protrude partially sideways, the clamp base can be made to fit the dimensions of the slot in the rail plate or rail tie.

In another aspect, this invention provides a rail clamp for fastening a rail to an underlying rail plate or rail tie, which rail clamp comprises a pair of substantially parallel members folded into a D configuration so as to have a front portion adapted to seat on a flange of the rail, which front portion is formed by respective free ends of the substantially parallel members, and a base portion adapted to seat in a slot in the rail plate or rail tie, wherein the parts of the substantially parallel members between the base portion and the front portion of the clamp are tapered in external dimensions towards the front portion, and the free ends of the substantially parallel members are turned back toward a rear portion of the clamp and project outwardly so as to abut a portion of the rail plate or rail tie when the clamp is in use, thereby to prevent the rail clamp sliding off the rail flange.

This tapering of the toe portion of the clamp means that as the clamp enters the slot of the rail plate or clamp support shoulder the arms of the clamp and the outwardly projecting ends of the toe portion are compressed toward each other to pass through the slot and once the toe portion is on the rail flange the external width of the outwardly projecting toe portions is greater than the slot width and the rail clamp is locked onto the rail flange. This arrangement overcomes the need for a custom built support shoulder or applicator tool.

BRIEF DESCRIPTION OF THE DRAWINGS

Reference will now be made, by way of example, to the accompanying drawings, in which:

As shown in FIGS. 1*a*, 1*b* and 1*c*, a K plate 1 is shaped to hold a rail (not shown) between the ribs 3 which are spaced from one another so as to abut the rail flange. Slots 4 provided in the ribs 3, as shown in cross section in FIG. 1*c*, and having sides 5 are located on opposite sides of the rail and are of constant cross section in a direction perpendicular to the rail. The associated rail clamps 10, as shown in FIGS. 2*a*, 2*b* and 2*c*, comprise in each case a pair of base legs 11, a rear web 13 to one end of which the rear ends of the base legs 11 are joined, front legs 14 which at their rear ends are joined to the other end of the rear web 13, toes 16 extending from the front ends of the front legs 14, respectively, and toe ends 18 facing rearwardly from the toes 16 and juxtaposed to the front ends of the base legs 11. The arrangement is such (see FIGS. 2*b* and 2*c*) that the base of the clamp, which is constituted by the legs 11, fits in the slot 4 and that the rearwardly facing ends 18 of the toes 16 of the clamp abut the ribs 3 at the outwardly facing sides 5 of the slots 4.

Figure 3A:
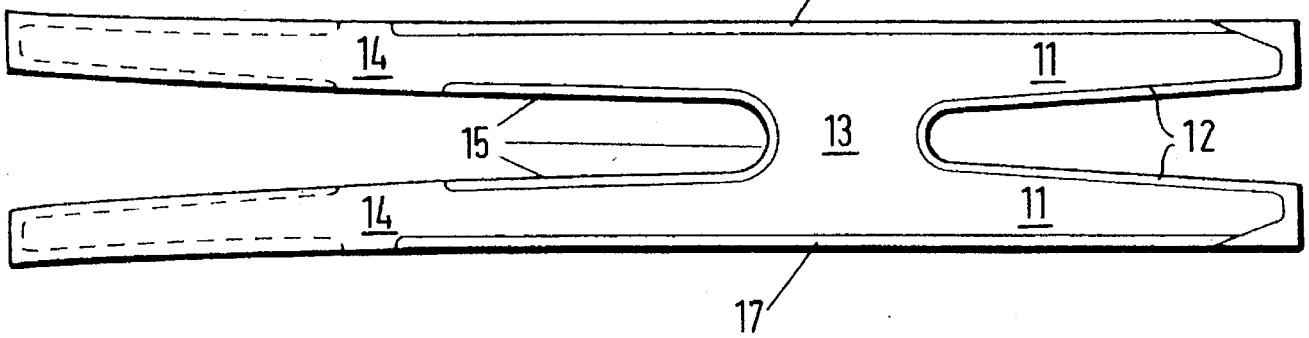
FIGS. 3*a* and 3*b* show plan views of first and second types of blanks formed during the process of shaping such a rail clamp from bar stock steel.

The rail clamp 10 is formed from bar stock by hot blanking the bar stock into the form shown in FIG. 3*a*. The blanking forms a pair of substantially parallel members 19 joined by a bridging web 13 therebetween and forming the base legs 11 and the front legs 14 is tapered form extending from the web 13. The hot blank is then coined along edges 12 of the web 13 and the legs 11 and along edges 15 of the web 13 and legs 14. The outer edges 17 of the blank are also coined. Coining reduces the likelihood of stress fractures.

Figure 1C:
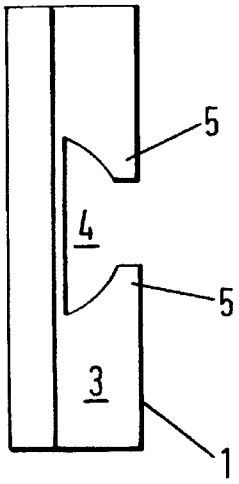
FIGS. 1*a*, 1*b* and 1*c* show, respectively, a top plate view, a side elevational view and a transverse sectional view of a K plate type of rail plate for use with rail clamps of the present invention.
Figure 1A:
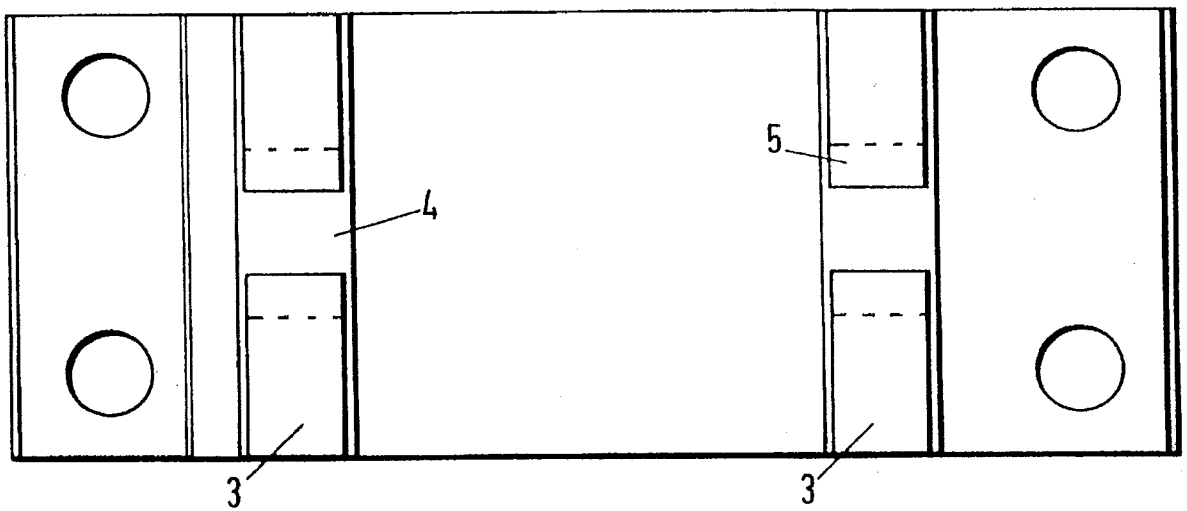
Figure 1B:
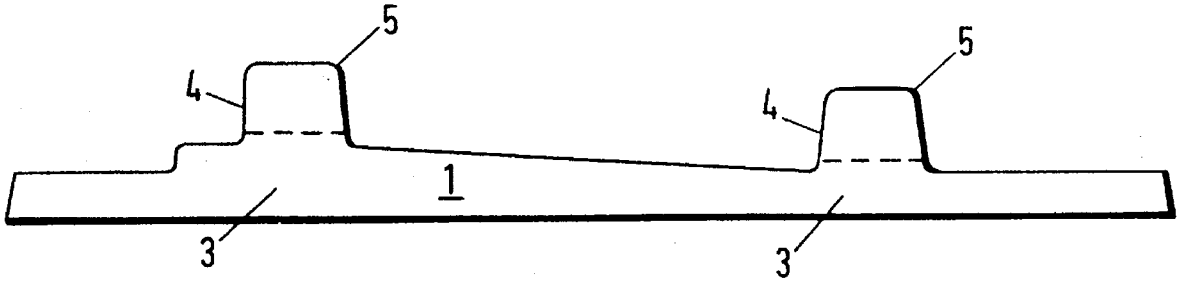
Figure 2A:
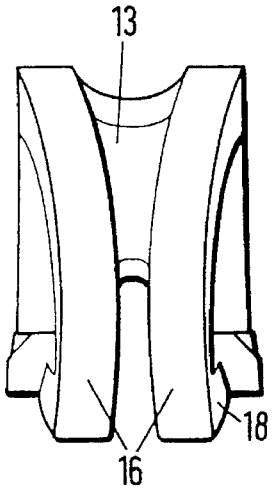
FIGS. 2*a*, 2*b* and 2*c* show, respectively, a front elevational view a side elevational view and a bottom plate view of a rail clamp embodying the present invention.
Figure 3B:
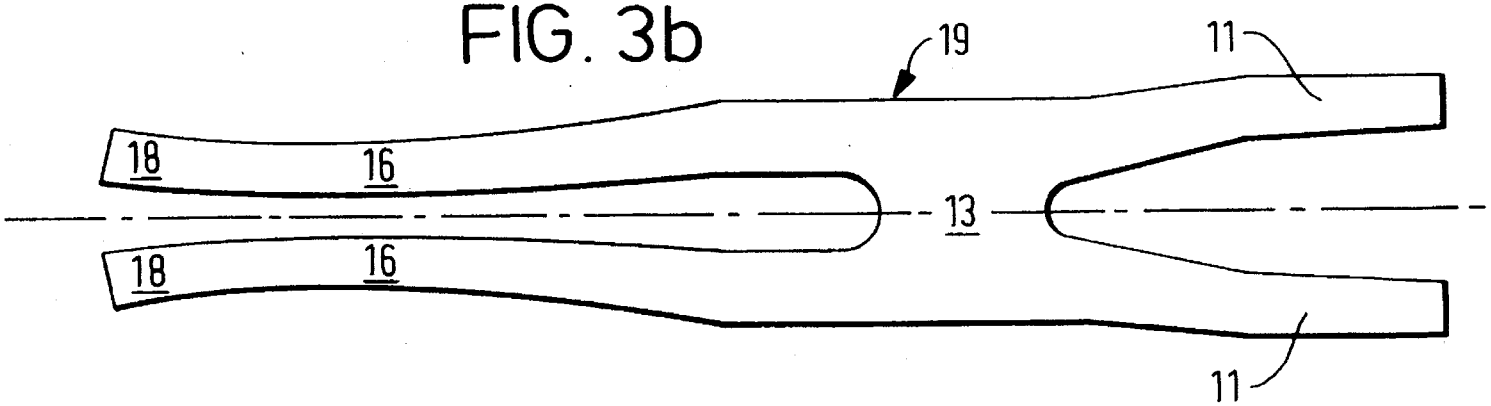

The next step in forming the rail clamp is as shown in FIG. 3*b* to form the legs 14 into a curved form in the two dimensions or planar blank which will produce the tapered toe portion of the final three dimensional or D shaped form as shown in FIG. 2*a*.

The narrowest width across the legs 14 in the FIG. 3*b* blank corresponds to the frontmost portion of the toe portion 16 of the clamp 10.

The second step also widens the base legs 11 to a size which will fit and secure the rail clamp 10 in the slot 4 of the rail plate 1.

Figure 2B:
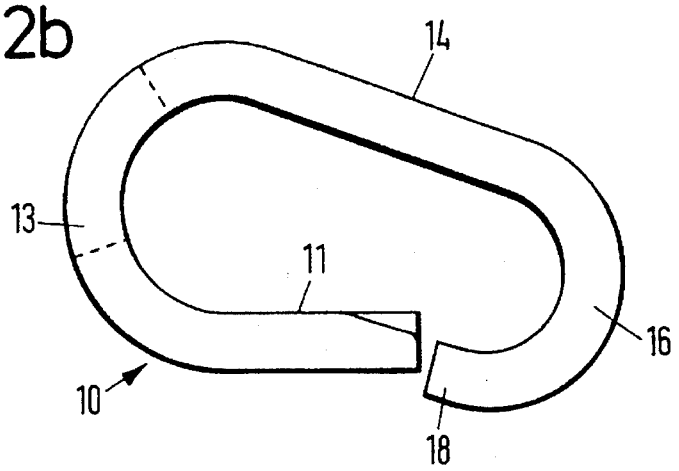
Figure 2C:
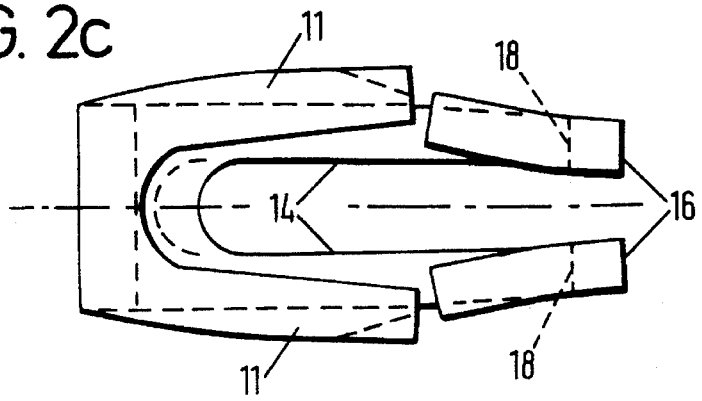

As shown in FIGS. 2*a*, 2*b* and 2*c* the rail clamp 10 has the web 13 joining the two arms 11 of the clamp at the rear of the clamp so that the web 13 can function to receive the force of the sledgehammer required to drive the clamp 10 so as to bring the toe ends 18 thereof into their operative positions in which they bear onto the rail flange.

The toe portion 16 is narrow enough to be compressed somewhat to the width of the upper portion of the slot 4 and thereby to be able to pass between the sides 5 of the slot and onto the rail flange. The toe ends 18 of the legs 14 then, after having cleared the substantially parallel-sided upper portion of the slot 4 and the outer side of the rib 3, snap apart and thereby prevent removal of the clamp 10 from the K plate and keep the toe ends 18 of the toe portion 16 on the rail flange. The long tapered legs 11 and 14 of the base and toe portions of the clamp 10 mean that the deflection range of the clamp 10 is greater than possible in prior art constructions.

From the above it can be seen that the present rail clamp is able to be used in a wider range of track situations without a custom made shoulder clamp or a special applicator tool.

I claim:

1. A rail clamp for fastening a rail to an underlying rail plate or rail tie, which rail clamp comprises a pair of laterally spaced substantially parallel members folded into a D configuration so as to have a front portion adapted to seat on a flange of the rail when the rail is located on the rail plate or the rail tie, which front portion is formed by respective free end regions of the substantially parallel members, and a base portion adapted to seat in a transverse slot provided either in the rail plate or in a shoulder secured to the rail tie, wherein parts of the substantially parallel members between the base portion and the front portion of the clamp are tapered inwards in external dimensions in the direction of the front portion, such that the free end regions of the substantially parallel members are able to be displaced towards one another as they pass through a substantially parallel-sided upper portion of the slot during installation of the clamp, and the free end regions of the substantially parallel members are turned back toward the base portion of the clamp and project outwardly in plan view so as to abut a portion of the rail plate or of the shoulder secured to the rail tie when the front portion of the clamp has passed through the slot and the free end regions of the substantially parallel members have been released, thereby to prevent the rail clamp from sliding off the rail flange.

2. A rail clamp as claimed in claim 1, wherein the front portion comprises two arms joined together by a web at ends of the arms located remote from the free end regions of the substantially parallel members.

3. A rail clamp as claimed in claim 2, wherein the base portion comprises two laterally spaced tapered legs joined together by a portion of the web remote from the juncture between the web and the arms of the front portion and adapted when received in the slot in the rail plate or the shoulder secured to the rail tie to extend toward the rail flange.

4. A rail clamp as claimed in claim 3, wherein the clamp is formed from bar steel or a width less than the width of the slot in the rail plate or the shoulder secured to the rail tie, and the lateral spacing between the legs of the base portion is sufficient to enable the width of the base portion to approximate the width of the slot.

5. An elastic rail clamp for fastening a rail to an underlying rail plate or rail tie, which clamp comprises a toe portion which is adapted to lie on a flange of the rail and a base portion which is adapted to seat in a slot provided either in the rail plate or in a shoulder secured to the rail tie, said clamp comprising a pair of substantially parallel members bent into a D configuration such that one end region of said pair of substantially parallel members forms the toe portion of the clamp and the other end region of the substantially parallel members forms the base portion of said clamp, the pair of members being joined together at a curved rear portion of the members intermediate the toe portion and the base portion.

6. A clamp as claimed in claim 5, wherein the pair of members are joined by a web which forms a rear surface of the rail clamp and is adapted to be parallel to the rail when the base portion is received in the slot in the rail plate or the shoulder secured to the rail tie, and two legs which are adapted to extend from said web toward said rail constitute the base portion of the clamp.

7. A rail clamp as claimed in claim 6, wherein the leg which constitute the base portion are tapered in the direction of respective free ends thereof.

8. A rail clamp as claimed in claim 5, wherein the clamp is wider across said base portion than across said curved rear portion.

* * * * *

UNITED STATES PATENT AND TRADEMARK OFFICE

CERTIFICATE OF CORRECTION

PATENT NO. : 5,605,284

DATED : February 25, 1997

INVENTOR(S) : Hartley F. Young

It is certified that error appears in the above-identified patent and that said Letters Patent is hereby corrected as shown below:

Column 2, line 47, for "plate" read --plan--.
Column 2, line 52, for "view" (first occurrence) read --view,--.
Column 2, line 52, for "plate" read --plan--.
Column 3, line 14, for "is" read --in--.
Column 3, line 21, for "dimensions" read --dimensional--.
Column 4, line 29, for "or" read --of--.
Column 4, line 54, for "leg" read --legs--.

Signed and Sealed this

Twenty-fourth Day of June, 1997

Bruce Lehman

*Attest:*

BRUCE LEHMAN

*Attesting Officer*

*Commissioner of Patents and Trademarks*